US006790148B1

(12) United States Patent
Yoshida et al.

(10) Patent No.: US 6,790,148 B1
(45) Date of Patent: Sep. 14, 2004

(54) MULTI-PIECE SOLID GOLF BALL AND METHOD OF MAKING THE SAME

(75) Inventors: Kazunari Yoshida, Kasai (JP); Keiji Ohama, Akashi (JP); Keiji Moriyama, Akashi (JP); Hidenori Hiraoka, Akashi (JP); Takumi Nishino, Akashi (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 09/478,367

(22) Filed: Jan. 6, 2000

(30) Foreign Application Priority Data

Jan. 20, 1999 (JP) ..... 11/11631
Sep. 21, 1999 (JP) ..... 11/267078

(51) Int. Cl.[7] ..... A63B 37/06
(52) U.S. Cl. ..... 473/374
(58) Field of Search ..... 473/373, 374, 473/367, 368, 370

(56) References Cited

U.S. PATENT DOCUMENTS 4,714,253 A * 12/1987 Nakahara et al. ..... 473/373
4,858,924 A * 8/1989 Saito et al. ..... 473/373
5,002,281 A * 3/1991 Nakahara et al. ..... 473/373
5,072,944 A * 12/1991 Nakahara et al. ..... 473/373
5,184,828 A * 2/1993 Kim et al. ..... 473/373
5,482,285 A * 1/1996 Yabuki et al. ..... 473/373
5,711,723 A 1/1998 Hiraoka et al.
5,782,707 A 7/1998 Yamagishi et al.
5,830,085 A 11/1998 Higuchi et al.

FOREIGN PATENT DOCUMENTS

JP A-8332247 12/1996
JP A-9239068 9/1997
JP A-9313643 12/1997

* cited by examiner

*Primary Examiner*—Raeann Gorden
(74) *Attorney, Agent, or Firm*—Birch, Stewart, Kolasch & Birch, LLP

(57) ABSTRACT

The present invention provides a multi-piece solid golf ball comprising a core consisting of an inner core and an outer core, and one or more layers of cover, wherein the inner core has a diameter of 30 to 39.5 mm and a center hardness in JIS-C hardness of 55 to 70, and is formed from press molded rubber composition comprising polybutadiene, a co-crosslinking agent, an organic peroxide and a filler, and the JIS-C hardness at a distance of 15 mm from the center point of the inner core is higher than the center hardness by 5 to 20; the outer core has a thickness of 0.3 to 2.0 mm and a surface hardness in JIS-C hardness of 75 to 90, and is formed from press molded rubber composition, and the surface hardness of the outer core is higher than the center hardness of the outer core is higher than the center hardness of the inner core by 10 to 35; and the cover contains thermoplastic resin as a base resin, and the outmost cover layer has a thickness of 1.5 to 2.5 mm and a surface hardness in Shore D hardness of 64 to 72.

4 Claims, 3 Drawing Sheets

MULTI-PIECE SOLID GOLF BALL AND METHOD OF MAKING THE SAME

FIELD OF THE INVENTION

The present invention relates to a multi-piece solid golf ball. More particularly, it relates to a multi-piece solid golf ball having excellent flight performance when hitting at low head speed or by an iron club, by accomplishing high rebound characteristics and high launch angle, and having good shot feel at the time of hitting.

BACKGROUND OF THE INVENTION

In the history of golf balls, a thread wound golf ball has been firstly developed. The thread wound golf ball is obtained by winding thread rubber in a stretched state on a solid or liquid center to form a thread wound core and covering it with a cover of balata, etc. having a thickness of 1 to 2 mm.

A two-piece solid golf ball has been subsequently developed, which is composed of a core formed from integrally molded rubber material and a thermoplastic resin cover (e.g. ionomer resin cover) formed on the core. The two-piece solid golf ball is easily produced because of simple structure, and has excellent rebound characteristics and excellent durability. Therefore, the two-piece solid golf ball is generally approved or employed by many golfers, mainly amateur golfers.

However, the two-piece solid golf ball exhibits harder and poorer shot feel at the time of hitting than the thread wound golf ball.

In order to provide a two-piece solid golf ball having a shot feel as good as the thread wound golf ball, a soft type two-piece solid golf ball using a softer core has been proposed. However, the use of the soft core adversely affects on rebound characteristics, thus resulting in a reduction in flight distance and a deterioration in durability.

It has been proposed to place an intermediate layer between the core and the cover of the two-piece solid golf ball to form a three-piece solid golf ball so as to maintain the balance between flight performance and shot feel at the time of hitting. The three-piece solid golf ball generally occupies the greater part of the golf ball market.

For example, a three-piece solid golf ball comprising a two-piece core composed of a core and an intermediate layer, which is formed from vulcanized rubber material having the same composition as the core, is suggested in Japanese Patent Kokai publication No. 332247/1996 and the like. However, in these golf balls, the thickness of the intermediate layer is too thin, and it is difficult to obtain sufficient rebound characteristics and high launch angle when hitting at low head speed (particularly, when hitting by a middle iron club and a short iron club).

Three-piece solid golf balls comprising an intermediate layer having thin thickness are also suggested in, for example, Japanese Patent Kokai publication Nos. 313643/1997, 239068/1997 and the like. However, in these golf balls, there have been problems that the rebound characteristics are degraded and the shot feel is hard and poor, because the intermediate layer is formed from thermoplastic resin.

OBJECTS OF THE INVENTION

A main object of the present invention is to provide a multi-piece solid golf ball having excellent flight performance when hitting at low head speed, by accomplishing high rebound characteristics and high launch angle, while maintaining good shot feel at the time of hitting.

According to the present invention, the object described above has been accomplished by adjusting the diameter, center hardness and hardness distribution of the inner core, the thickness and surface hardness of the outer core, the hardness distribution of the core, and the thickness and hardness of the cover to a specified range. The present invention can provide a multi-piece solid golf ball having excellent flight performance when hitting at low head speed, by accomplishing high rebound characteristics and high launch angle, while maintaining good shot feel at the time of hitting.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustration only, and thus are not limitative of the present invention, and wherein.

SUMMARY OF THE INVENTION

The present invention provides a multi-piece solid golf ball comprising a core consisting of an inner core and an outer core formed on the inner core, and one or more layers of cover covering the core, wherein the inner core has a diameter of 30 to 39.5 mm and a center hardness in JIS-C hardness of 55 to 70, and is formed from press molded rubber composition comprising polybutadiene, a co-crosslinking agent, an organic peroxide and a filler, and the JIS-C hardness at a distance of 15 mm from the center point of the inner core is higher than the center hardness by 5 to 20, the outer core has a thickness of 0.3 to 2.0 mm and a surface hardness in JIS-C hardness of 75 to 90, and is formed from press molded rubber composition comprising polybutadiene, a co-crosslinking agent, an organic peroxide and a filler, and the surface hardness of the outer core is higher than the center hardness of the inner core by 10 to 35, and the cover contains thermoplastic resin as a base resin, and the outmost cover layer has a thickness of 1.5 to 2.5 mm and a surface hardness in Shore D hardness of 64 to 72.

DETAILED DESCRIPTION OF THE INVENTION

Figure 1:
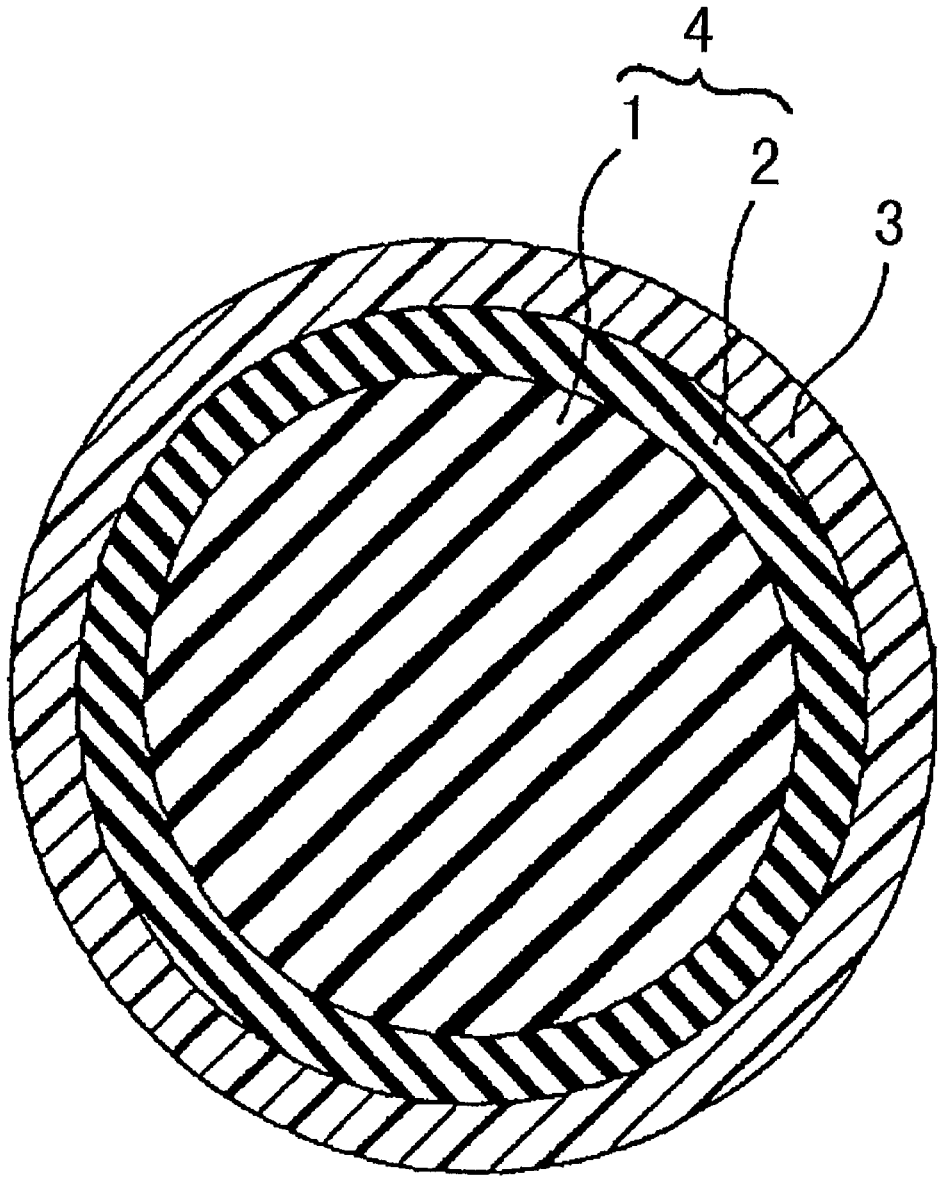
FIG. 1 is a schematic cross section illustrating one embodiment of the golf ball of the present invention.

The multi-piece solid golf ball of the present invention will be explained with reference to the accompanying drawing in detail. FIG. 1 is a schematic cross section illustrating one embodiment of the multi-piece solid golf ball of the present invention. As shown in FIG. 1, the golf ball of the present invention comprises a core 4 consisting of an inner core 1 and an outer core 2 formed on the inner core 1, and one or more layers of cover 3 covering the core 4. In order to explain the golf ball of the present invention simply, a golf ball having one layer of cover 3 will be used hereinafter for explanation. However, the golf ball of the present invention may be applied for the golf ball having two or more layers of cover.

The core 4, including both the inner core 1 and the outer core 2, is obtained from a rubber composition. The rubber composition essentially contains polybutadiene, a co-crosslinking agent, an organic peroxide and a filler.

The polybutadiene used for the core 4 of the present invention may be one, which has been conventionally used for cores of solid golf balls. Preferred is high-cis polybutadiene rubber containing a cis-1, 4 bond of not less than 40%, preferably not less than 80%. The high-cis polybutadiene rubber may be optionally mixed with natural rubber, polyisoprene rubber, styrene-butadiene rubber, ethylene-propylene-diene rubber (EPDM) and the like.

The co-crosslinking agent can be a metal salt of α,β-unsaturated carboxylic acid, including mono or divalent metal salts, such as zinc or magnesium salts of α,β-unsaturated carboxylic acids having 3 to 8 carbon atoms (e.g. acrylic acid, methacrylic acid, etc.), or a blend of the metal salt of α,β-unsaturated carboxylic acid and acrylic ester or methacrylic ester and the like. Preferred co-crosslinking agent is zinc acrylate because it imparts high rebound characteristics to the resulting golf ball. The amount of the co-crosslinking agent composition is from 5 to 70 parts by weight, preferably from 5 to 65 parts by weight, more preferably from 5 to 50 parts by weight, most preferably 10 to 40 parts by weight, based on 100 parts by weight of the polybutadiene. When the amount of the co-crosslinking agent is larger than 70 parts by weight, the core is too hard, and thus shot feel is poor. On the other hand, when the amount of the co-crosslinking agent is smaller than 5 parts by weight, it is required to increase an amount of the organic peroxide in order to impart a desired hardness to the core. Therefore, the rebound characteristics are degraded, which reduces the flight distance.

The organic peroxide includes, for example, dicumyl peroxide, 1,1-bis (t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide is from 0.2 to 7.0 parts by weight, preferably 0.5 to 5.0 parts by weight, based on 100 parts by weight of the polybutadiene. When the amount of the organic peroxide is smaller than 0.2 parts by weight, the core is too soft, and the rebound characteristics are degraded, which reduces the flight distance. On the other hand, when the amount of the organic peroxide is larger than 7.0 parts by weight, it is required to decrease an amount of the co-crosslinking agent in order to impart a desired hardness to the core. Therefore, the rebound characteristics are degraded, which reduces the flight distance.

The filler, which can be typically used for the core of solid golf ball, includes for example, inorganic filler (such as zinc oxide, barium sulfate, calcium carbonate, magnesium oxide and the like), high specific gravity metal powder filler (such as tungsten powder, molybdenum powder and the like), and the mixture thereof. The amount of the filler is not limited and can vary depending on the specific gravity and size of the cover and core, but is from 3 to 50 parts by weight, preferably from 10 to 30 parts by weight, based on 100 parts by weight of the polybutadiene. When the amount of the filler is smaller than 3 parts by weight, it is difficult to adjust the weight of the resulting golf ball. On the other hand, when the amount of the filler is larger than 50 parts by weight, the weight ratio of the rubber component in the core is small, and the rebound characteristics reduce too much.

The rubber composition for the core of the golf ball of the present invention can contain other components, which have been conventionally used for preparing the core of solid golf balls, such as antioxidant or peptizing agent. If used, the amount of the antioxidant is preferably 0.1 to 1.0 parts by weight, and an amount of the peptizing agent is preferably 0.1 to 5.0 parts by weight, based on 100 parts by weight of the polybutadiene.

Figure 2:
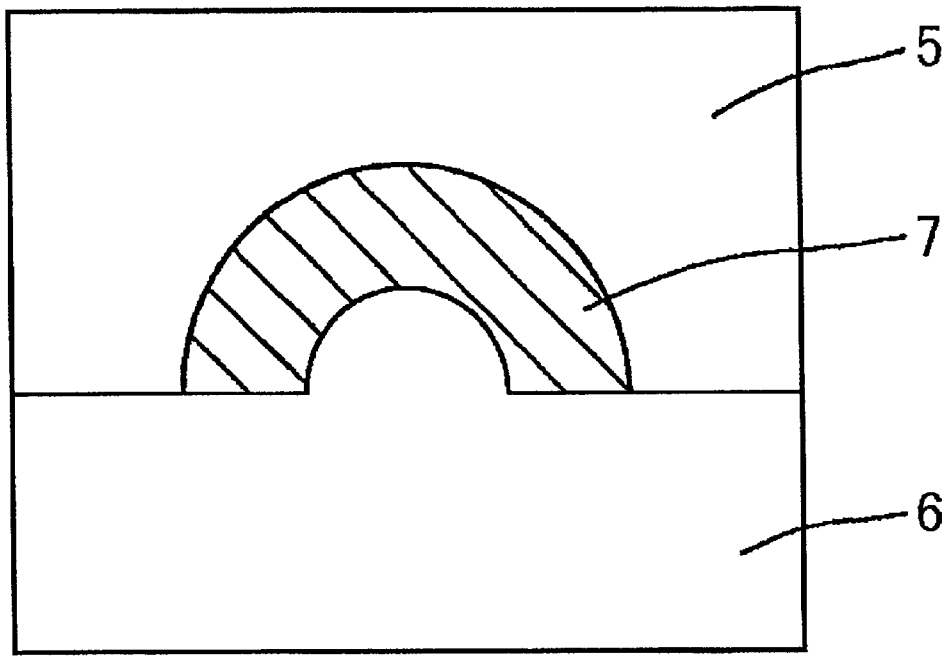
FIG. 2 is a schematic cross section illustrating one embodiment of a mold for molding an outer core of the golf ball of the present invention.
Figure 3:
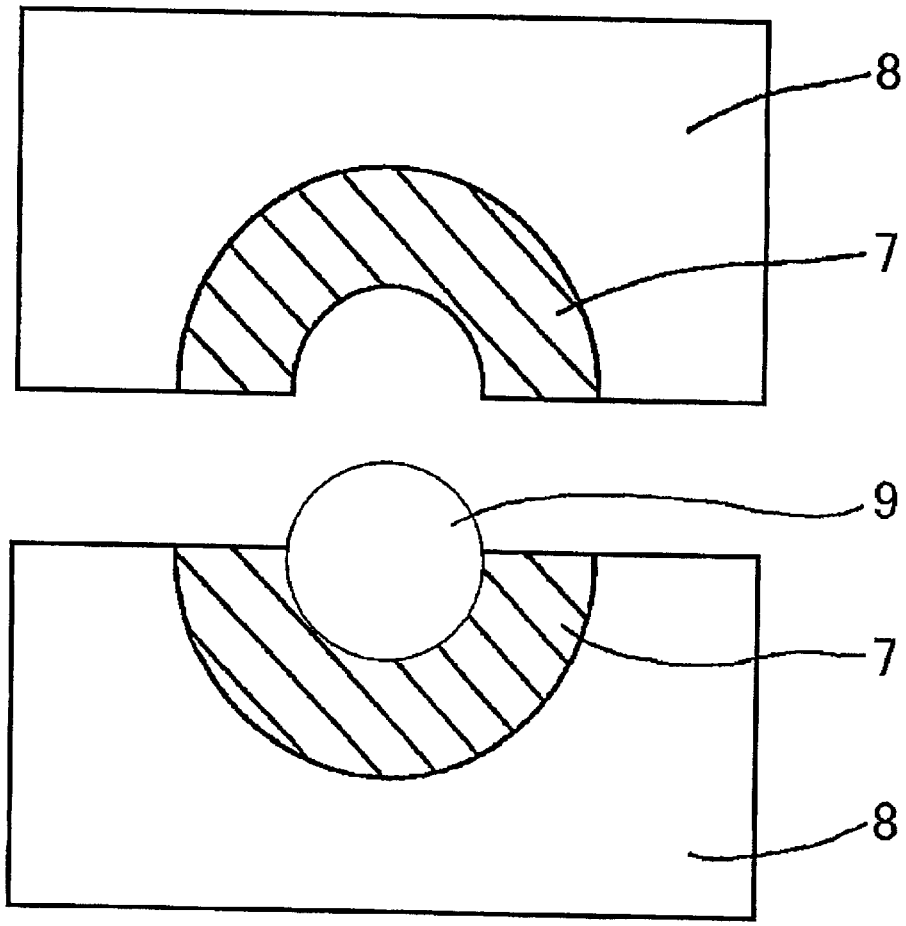
FIG. 3 is a schematic cross section illustrating one embodiment of a mold for molding a core of the golf ball of the present invention.

The process of producing the core of the golf ball of the present invention will be explained with reference to FIG. 2 and FIG. 3. FIG. 2 is a schematic cross section illustrating one embodiment of a mold for molding an outer core of the golf ball of the present invention. FIG. 3 is a schematic cross section illustrating one embodiment of a mold for molding a core of the golf ball of the present invention. The rubber composition for the inner core is molded by using an extruder to form a cylindrical unvulcanized inner core. The rubber composition for the outer core is then vulcanized by press-molding, for example, at 120 to 160° C. for 2 to 30 minutes using a mold having a semi-spherical cavity 5 and a male plug mold 6 having a semi-spherical convex having the same shape as the inner core as described in FIG. 2 to obtain a vulcanized semi-spherical half-shell 7 for the outer core. The unvulcanized inner core 9 is covered with the two vulcanized semi-spherical half-shells 7 for the outer core, and then vulcanized by integrally press-molding, for example, at 140 to 180° C. for 10 to 60 minutes in a mold 8 for molding a core, which is composed of an upper mold and a lower mold, as described in FIG. 3 to obtain the core 4. The core 4 is composed of the inner core 1 and the outer core 2 formed on the inner core.

In the golf ball of the present invention, the inner core 1 has a diameter of 30 to 39.5 mm, preferably 32.5 to 38.5 mm, more preferably 32.5 to 38.0 mm, most preferably 32.5 to 36.5 mm. When the diameter of the center is smaller than 30 mm, it is required to increase the thickness of the outer core or the cover to a thickness less than a desired thickness. Therefore, the shot feel is hard and poor. On the other hand, when the diameter of the inner core is larger than 39.5 mm, the technical effect accomplished by the structure that the outer portion is harder and the inner portion is softer in the golf ball can not be sufficiently obtained. Therefore, the launch angle is small.

In the golf ball of the present invention, the inner core 1 has a center hardness in JIS-C hardness of 55 to 70, preferably 59 to 67, more preferably 62 to 66. When the hardness is smaller than 55, the shot feel is heavy and poor, and the inner core is too soft, and the rebound characteristics are degraded, which reduces the flight distance. On the other hand, the hardness is larger than 70, the inner core is too hard, and the shot feel is hard and poor. In addition, the launch angle is small, which reduces the flight distance, although the rebound characteristics are sufficiently maintained. The diameter of the inner core has a great effect on the performance of the golf ball particularly when hitting at low head speed.

In the golf ball of the present invention, it is required that the JIS-C hardness at a distance of 15 mm from the center point of the inner core 1 is higher than the center hardness by 5 to 20, preferably 5 to 15. When the hardness difference is larger than 20, the rebound characteristics are degraded, and the shot feel is heavy and poor. When the hardness difference is smaller than 5, the launch angle is small, which reduces the flight distance. The JIS-C hardness at a distance of 15 mm from the center point of the inner core is 60 to 90, preferably 65 to 85, more preferably 70 to 80. when the hardness is smaller than 60, the shot feel is heavy and poor, and the inner core is too soft and the rebound characteristics are degraded. On the other hand, when the hardness is larger than 90, the shot feel is hard and poor. The center hardness and the hardness at a distance of 15 mm from the center point of the inner core are determined by measuring hardness at the center point and at a distance of 15 mm from the center point of the inner core, after the core, which is formed by integrally press-molding the inner core and the outer core, is cut into two equal parts.

In the golf ball of the present invention, the outer core 2 has a thickness of 0.3 to 2.0 mm, preferably 0.5 to 1.8 mm, more preferably 1.3 to 1.8 mm. When the thickness is smaller than 0.3 mm, the technical effect accomplished by the hardness difference between the outer core and inner core can not be sufficiently obtained, and high launch angle and high rebound characteristics can not be sufficiently accomplished. Therefore, it is desired that the thickness of the outer core 2 is not less than 0.4 mm, preferably not less than 0.5, as a lower limit. On the other hand, when the thickness is larger than 2.0 mm, the rebound characteristics are improved, but the launch angle is small and the shot feel is hard and poor. The thickness of the outer core has a great effect on the performance of the golf ball particularly when hitting at low head speed or hitting by a middle iron club to short iron club, and the launch angle is small, which reduces the flight distance. Therefore, it is desired that the thickness of the outer core is not more than 1.8 mm, preferably not more than 1.5 mm, as an upper limit. The upper limit can be set in combination with the above lower limit to set a preferable limit.

In the golf ball of the present invention, the outer core 2 has a surface hardness in JIS-C hardness of 75 to 90, preferably 79 to 88, more preferably 82 to 86. When the surface hardness is smaller than 75, the launch angle is small, and the rebound characteristics are degraded, which reduces the flight distance. On the other hand, when the surface hardness is larger than 90, the outer core is too hard, and the shot fell is poor. In the present invention, it is required that the surface hardness of the outer core is higher than the center hardness of the inner core by 10 to 35, preferably 15 to 30. When the hardness difference is smaller than 10, high launch angle and high rebound characteristics can not be sufficiently accomplished, which reduces the flight distance. On the other hand, when the hardness distance is larger than 35, the shot feel is heavy or hard and poor. As used herein, the term "a surface hardness of the outer core" means the surface hardness of the core having a two-layered structure, which is formed by integrally press-molding the inner core and the outer core.

In the golf ball of the present invention, it is required that the outer core 2 is formed by press-molding the rubber composition as used in the inner core 1, which essentially contains polybutadiene, a co-crosslinking agent, an organic peroxide and a filler. Since the outer core 2, which is not formed from thermoplastic resin, such as ionomer resin, thermoplastic elastomer, diene copolymer and the like, is formed from the press-molded article of the rubber composition, the rebound characteristics are improved and the shot feel is good. Since the inner core 1 and the outer core 2 are formed from the same vulcanized rubber composition, the adhesion between the inner core 1 and the outer core 2 is excellent, and the durability is improved. Rubber, when compared with resin, has a little deterioration of performance at low temperature lower than room temperature as known in the art, and thus the outer core of the present invention formed from the rubber has excellent rebound characteristics at low temperature.

One or more layers of cover 3 are then covered on the core 4. In the golf ball of the present invention, it is required that the outmost layer of the cover 3 has a thickness of 1.5 to 2.5 mm, preferably 1.8 to 2.3 mm. When the thickness is smaller than 1.5 mm, the rebound characteristics and the durability are degraded. On the other hand, when the thickness is larger than 2.5 mm, the shot feel is hard and poor. In the golf ball of the present invention, it is required that the outmost layer of the cover 3 has a surface hardness in Shore D of 64 to 72, preferably 65 to 71. When the hardness is smaller than 64, the launch angle is small and the spin amount is large, and the rebound characteristics are degraded, which reduces the flight distance. On the other hand, when the hardness is larger than 72, the shot feel is hard and poor.

The cover 3 of the present invention contains thermoplastic resin, particularly ionomer resin, which has been conventionally used for the cover of golf balls, as a base resin. The ionomer resin may be a copolymer of ethylene and α,β-unsaturated carboxylic acid having 3 to 8 carbon atoms, of which a portion of carboxylic acid groups is neutralized with metal ion, or a terpolymer of ethylene, α,β-unsaturated carboxylic acid and α,β-unsaturated carboxylic acid ester, of which a portion of carboxylic acid groups is neutralized with metal ion. Examples of the α,β-unsaturated carboxylic acid in the ionomer include acrylic acid, methacrylic acid, fumaric acid, maleic acid, crotonic acid and the like, preferred are acrylic acid and methacrylic acid. Examples of the α,β-unsaturated carboxylic acid ester in the ionomer include methyl ester, ethyl ester, propyl ester, n-butyl ester and isobutyl ester of acrylic acid, methacrylic acid, fumaric acid, maleic acid and the like. Preferred are acrylic acid esters and methacrylic acid esters. The metal ion which neutralizes a portion of carboxylic acid groups of the copolymer or terpolymer includes a sodium ion, a potassium ion, a lithium ion, a magnesium ion, a calcium ion, a zinc ion, a barium ion, an aluminum, a tin ion, a zirconium ion, cadmium ion, and the like. Preferred are sodium ions, zinc ions, magnesium ions and the like, in view of rebound characteristics, durability and the like.

The ionomer resin is not limited, but examples thereof will be shown by a trade name thereof. Examples of the ionomer resins, which are commercially available from Mitsui Du Pont Polychemical Co., Ltd. include Hi-milan 1555, Hi-milan 1557, Hi-milan 1605, Hi-milan 1652, Hi-milan 1702, Hi-milan 1705, Hi-milan 1706, Hi-milan 1707, Hi-milan 1855, Hi-milan 1856 and the like. Examples of the ionomer resins, which are commercially available from Du Pont Co., include Surlyn 8945, Surlyn 9945, Surlyn AD8511, Surlyn AD8512, Surlyn AD8542 and the like. Examples of the ionomer resins, which are commercially available from Exxon Chemical Co., include Iotek 7010, Iotek 8000 and the like. These ionomer resins may be used alone or in combination.

As the materials suitably used in the cover 3 of the present invention, the above ionomer resin may be used alone, but the ionomer resin may be used in combination with at least one of thermoplastic elastomer, diene block copolymer and the like.

Examples of the thermoplastic elastomers include polyamide thermoplastic elastomer, which is commercially available from Toray Co., Ltd. under the trade name of "Pebax" (such as "Pebax 2533S"); polyester thermoplastic elastomer, which is commercially available from Toray-Do Pont Co., Ltd. under the trade name of "Hytrel" (such as "Hytrel 3548", "Hytrel 4047"); polyurethane elastomer, which is commercially available from Takeda Verdishe Co., Ltd. under the trade name of "Elastoran" (such as "Elastoran ET880"); and the like.

The diene block copolymer is a block copolymer or partially hydrogenated block copolymer having double bond derived from conjugated diene compound. The base bock copolymer is block copolymer composed of block polymer block A mainly comprising at least one aromatic vinyl compound and polymer block B mainly comprising at least one conjugated diene compound. The partially hydrogenated block copolymer is obtained by hydrogenating the block copolymer. Examples of the aromatic vinyl compounds comprising the block copolymer include styrene, α-methyl styrene, vinyl toluene, p-t-butyl styrene, 1,1-diphenyl styrene and the like, or mixtures thereof. Preferred is styrene. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof. Examples of the diene block copolymers which is commercially available include the diene block copolymers, which are commercially available from Daicel Chemical Industries, Ltd. under the trade name of "Epofriend" (such as "Epofriend A1010") and the like.

The amount of the thermoplastic elastomer or diene block copolymer is 1 to 60 parts by weight, preferably 1 to 35 parts by weight, based on 100 parts by weight of the base resin for the cover. When the amount is smaller than 1 parts by weight, the technical effect of absorbing the impact force at the time of hitting accomplishing by using them can not be sufficiently obtained. On the other hand, when the amount is larger than 60 parts by weight, the cover is too soft and the rebound characteristics are degraded, or the compatibility with the ionomer resin is degraded and the durability is degrade.

The composition for the cover 3 used in the present invention may optionally contain pigments (such as titanium dioxide, etc.) and the other additives such as a dispersant, an antioxidant, a UV absorber, a photostabilizer and a fluorescent agent or a fluorescent brightener, etc., in addition to the resin component, as long as the addition of the additives does not deteriorate the desired performance of the golf ball cover.

A method of covering on the core 4 with the cover 3 is not specifically limited, but may be a conventional method. For example, there can be used a method comprising molding the cover composition into a semi-spherical half-shell in advance, covering the core, which is covered with the outer core, with the two half-shells, followed by pressure molding at 130 to 170° C. for 1 to 5 minutes, or a method comprising injection molding the cover composition directly on the core, which is covered with the core, to cover it. At the time of molding the cover, many depressions called "dimples" may be optionally formed on the surface of the golf ball. Furthermore, paint finishing or marking with a stamp may be optionally provided after the cover molded for commercial purposes.

EXAMPLES

The following Examples and Comparative Examples further illustrate the present invention in detail but are not to be construed to limit the scope of the present invention.

(i) Production of Unvulcanized Spherical Inner Core

The rubber compositions for the inner core having the formulation shown in Tables 1 and 2 (Examples) and Tables 3 and 4 (Comparative Examples) were mixed, and then extruded to obtain spherical unvulcanized plugs.

(ii) Production of Vulcanized Semi-spherical Half-shell for the Outer Core

The rubber compositions for the outer core having the formulation shown in Tables 1 and 2 (Examples) and Tables 3 and 4 (Comparative Examples) were mixed, and then vulcanized by press-molding at the vulcanization condition shown in the same Tables in the mold (5, 6) as described in FIG. 2 to obtain vulcanized semi-spherical half-shells 7 for the outer core.

(iii) Production of Core (a) Cores for Examples 1 to 12 and

Comparative Examples 1 to 7

The spherical unvulcanized plugs 9 produced in the step (i) were covered with the two vulcanized semi-spherical half-shells 7 for the outer core produced in the step (ii), and then vulcanized by press-molding at the vulcanization condition shown in Tables 1 and 2 (Examples) and Tables 3 and 4 (Comparative Examples) in the mold 8 as described in FIG. 3 to obtain cores 4 having a two-layered structure. A surface hardness in JIS-C hardness of the resulting core was measured. The results are shown in Tables 8 and 9 (Examples) and Tables 10 and 11 (Comparative Examples) as a surface hardness of the outer core (C). The diameter, the hardness at the center point (A) and the hardness at a distance of 15 mm from the center point (B) of the inner core, and the thickness of the outer core were also measured, and the hardness difference (B−A) and (C−A) were calculated. The results are shown in the same Tables.

TABLE 1

(parts by weight)

| | Example No. | | | | | |
|---|---|---|---|---|---|---|
| Core composition | 1 | 2 | 3 | 4 | 5 | 6 |
| (Inner core composition) | | | | | | |
| Polybutadiene *1 | 100 | 100 | 100 | 100 | 100 | 100 |
| Zinc acrylate | 25.0 | 23.0 | 23.0 | 22.0 | 21.5 | 18.0 |
| Zinc oxide | 28.82 | 21.55 | 21.55 | 22.28 | 22.10 | 23.38 |
| Dicumyl peroxide | 1.3 | 1.3 | 1.3 | 1.3 | 1.3 | 1.3 |
| Diphenyl disulfide | 0.5 | 0.5 | 0.5 | 0.5 | 0.5 | 0.5 |

TABLE 1-continued (parts by weight)

| Core composition | | | Example No. 1 | 2 | 3 | 4 | 5 | 6 |
|---|---|---|---|---|---|---|---|---|
| (Outer core composition) | | | | | | | | |
| Polybutadiene *1 | | | 100 | 100 | 100 | 100 | 100 | 100 |
| Zinc acrylate | | | 29.0 | 34.0 | 34.0 | 34.0 | 34.0 | 39.0 |
| Zinc oxide | | | 18.92 | 17.1 | 17.1 | 17.1 | 17.1 | 15.27 |
| Dicumyl peroxide | | | 1.0 | 1.0 | 1.0 | 1.0 | 1.0 | 1.0 |
| Vulcanization condition: temperature(° C.) × time(min) | | | | | | | | |
| Outer core | | (° C.) | 143 | 143 | 143 | 143 | 143 | 145 |
| | | (min) | 5 | 5 | 5 | 5 | 5 | 5 |
| Core | The first stage | (° C.) | 144 | 144 | 144 | 140 | 144 | 144 |
| | | (min) | 25 | 25 | 25 | 29 | 25 | 25 |
| | The second stage | (° C.) | 165 | 165 | 165 | 165 | 165 | 165 |
| | | (min) | 8 | 8 | 8 | 8 | 8 | 8 |

TABLE 2

(parts by weight)

| Core composition | | | Example No. 7 | 8 | 9 | 10 | 11 | 12 |
|---|---|---|---|---|---|---|---|---|
| (Inner core composition) | | | | | | | | |
| Polybutadiene *1 | | | 100 | 100 | 100 | 100 | 100 | 100 |
| Zinc acrylate | | | 23.0 | 23.0 | 23.0 | 23.0 | 28.5 | 28.5 |
| Zinc oxide | | | 21.55 | 21.55 | 21.55 | 21.55 | 18.60 | 18.60 |
| Dicumyl peroxide | | | 1.3 | 1.3 | 1.3 | 1.3 | 0.6 | 0.6 |
| Diphenyl disulfide | | | 0.5 | 0.5 | 0.5 | 0.5 | 0.5 | 0.5 |
| (Outer core composition) | | | | | | | | |
| Polybutadiene *1 | | | 100 | 100 | 100 | 100 | 100 | 100 |
| Zinc acrylate | | | 34.0 | 34.0 | 34.0 | 34.0 | — | — |
| Magnesium methacrylate | | | — | — | — | — | 45.5 | 45.5 |
| Acrylic ester | | | — | — | — | — | 17.8 | 17.8 |
| Zinc oxide | | | 17.1 | 17.1 | 17.1 | 17.1 | — | — |
| Magnesium oxide | | | — | — | — | — | 23.0 | 23.0 |
| Dicumyl peroxide | | | 1.0 | 1.0 | 1.0 | 1.0 | 2.0 | 2.0 |
| Tungsten | | | — | — | — | — | 48.7 | 48.7 |
| Vulcanization condition: temperature(° C.) × time(min) | | | | | | | | |
| Outer core | | (° C.) | 143 | 143 | 143 | 143 | 135 | 135 |
| | | (min) | 5 | 5 | 5 | 5 | 5 | 5 |
| Core | The first stage | (° C.) | 144 | 144 | 144 | 144 | 150 | 150 |
| | | (min) | 25 | 25 | 25 | 25 | 25 | 25 |
| | The second stage | (° C.) | 165 | 165 | 165 | 165 | 165 | 165 |
| | | (min) | 8 | 8 | 8 | 8 | 8 | 8 |

TABLE 3

(parts by weight)

| Core composition | Comparative Example No. 1 | 2 | 3 | 4 | 5 |
|---|---|---|---|---|---|
| (Inner core composition) | | | | | |
| Polybutadiene *1 | 100 | 100 | 100 | 100 | 100 |
| Zinc acrylate | 25.0 | 22.0 | 25.0 | 23.0 | 23.0 |
| Zinc oxide | 20.82 | 22.28 | 20.82 | 21.55 | 21.55 |

TABLE 3-continued (parts by weight)

| Core composition | Comparative Example No. 1 | 2 | 3 | 4 | 5 |
|---|---|---|---|---|---|
| Dicumyl peroxide | 1.3 | 1.3 | 1.3 | 1.3 | 1.3 |
| Diphenyl disulfide | 0.5 | 0.5 | 0.5 | 0.5 | 0.5 |
| (Outer core composition) | | | | | |
| Polybutadiene *1 | 100 | 100 | 100 | 100 | 100 |
| Zinc acrylate | 34.0 | 34.0 | 29.0 | 22.0 | 34.0 |

TABLE 3-continued (parts by weight)

| Core composition | | | Comparative Example No. 1 | 2 | 3 | 4 | 5 |
|---|---|---|---|---|---|---|---|
| Zinc oxide | | | 17.1 | 17.1 | 18.92 | 21.91 | 17.1 |
| Dicumyl peroxide | | | 1.0 | 1.0 | 1.0 | 1.0 | 1.0 |
| Vulcanization condition: temperature(° C.) × time(min) | | | | | | | |
| Outer core | | (° C.) | 143 | 143 | 143 | 140 | 143 |
| | | (min) | 5 | 5 | 5 | 5 | 5 |
| Core | The first stage | (° C.) | 140 | 140 | 140 | 144 | 144 |
| | | (min) | 29 | 29 | 29 | 25 | 25 |
| | The second stage | (° C.) | 165 | 165 | 165 | 165 | 165 |
| | | (min) | 8 | 8 | 8 | 8 | 8 |

TABLE 4

(parts by weight)

| Core composition | | | Comparative Example No. 6 | 7 | 8 | 9 | 10 | 11 |
|---|---|---|---|---|---|---|---|---|
| (Inner core composition) | | | | | | | | |
| Polybutadiene *1 | | | 100 | 100 | 100 | 100 | 100 | 100 |
| Zinc acrylate | | | 23.0 | 23.0 | 23.0 | 23.0 | 23.0 | 23.0 |
| Zinc oxide | | | 21.55 | 21.55 | 22.28 | 22.28 | 22.28 | 22.28 |
| Dicumyl peroxide | | | 1.3 | 1.3 | 1.3 | 1.3 | 1.3 | 1.3 |
| Diphenyl disulfide | | | 0.5 | 0.5 | 0.5 | 0.5 | 0.5 | 0.5 |
| (Outer core composition) | | | | | | | | |
| Polybutadiene *1 | | | 100 | 100 | ** | ** | ** | ** |
| Zinc acrylate | | | 34.0 | 34.0 | | | | |
| Zinc oxide | | | 17.1 | 17.1 | | | | |
| Dicumyl peroxide | | | 1.0 | 1.0 | | | | |
| Vulcanization condition: temperature(° C.) × time(min) | | | | | | | | |
| Outer core | | (° C.) | 143 | 143 | — | — | — | — |
| | | (min) | 10 | 10 | — | — | — | — |
| Core | The first stage | (° C.) | 144 | 144 | 144 | 144 | 144 | 144 |
| | | (min) | 25 | 25 | 25 | 25 | 25 | 25 |
| | The second stage | (° C.) | 165 | 165 | 165 | 165 | 165 | 165 |
| | | (min) | 8 | 8 | 8 | 8 | 8 | 8 |

**: The formulation of the composition for the outer layer core is described in Table 5.
*1: Polybutadiene (trade name "BR-11") available from JSR Co., Ltd. (Content of 1,4-cis-polybutadiene: 96%)

(b) Cores for Comparative Examples 8 to 11

The compositions for the outer core having the formulation shown in Table 5 were directly injection molded on the spherical unvulcanized plugs 9 produced in the step (i) to obtain cores 4 having a two-layered structure. A surface hardness in JIS-C hardness of the resulting core 4 was measured. The results are shown in Table 11 as a surface hardness of the outer core (C). The diameter, the hardness at the center point (A) and the hardness at a distance of 15 mm from the center point (B) of the inner core, and the thickness of the outer core were also measured, and the hardness difference (B−A) and C) (C−A) were calculated. The results are shown in the same Tables.

TABLE 5

| Outer layer core composition | | Comparative Example No. 8 | 9 | 10 | 11 |
|---|---|---|---|---|---|
| Hi-milan 1702 | *5 | 22 | 22 | 22 | 22 |
| Surlyn 8945 | *8 | 23 | 23 | 23 | 23 |
| Surlyn AD8542 | *10 | 30 | 30 | 30 | 30 |
| Pebax 2533S | *11 | 15 | 15 | 15 | 15 |
| Epofriend A1010 | *12 | 10 | 10 | 10 | 10 |

(iv) Preparation of Cover Compositions

The formulation materials shown in Table 6 (Examples) and Tables 7 (Comparative Examples) were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 150 to 260° C. at the die position of the extruder. The Shore D hardness of the resulting cover compositions were measured, and the results are shown in Tables 8 and 9 (Examples) and Tables 10 and 11 (Comparative Examples). The test methods are described later.

TABLE 6

(parts by weight)

| Cover composition | Example No. 1 | 2 | 3 | 4 | 5 | 6 | 7 | 8 | 9 | 10 | 11 | 12 |
|---|---|---|---|---|---|---|---|---|---|---|---|---|
| Hi-milan 1555 *2 | 6 | 6 | — | 6 | 6 | 6 | 6 | 6 | — | — | 6 | 6 |

TABLE 6-continued (parts by weight)

| Cover composition | Example No. 1 | 2 | 3 | 4 | 5 | 6 | 7 | 8 | 9 | 10 | 11 | 12 |
|---|---|---|---|---|---|---|---|---|---|---|---|---|
| Hi-milan 1557 *3 | 6 | 6 | — | 6 | 6 | 6 | 6 | 6 | — | — | 6 | 6 |
| Hi-milan 1605 *4 | 44 | 44 | — | 44 | 44 | 44 | 44 | 44 | — | — | 44 | 44 |
| Hi-milan 1702 *5 | — | — | — | — | — | — | — | — | — | — | — | — |
| Hi-milan 1706 *6 | 44 | 44 | — | 44 | 44 | 44 | 44 | 44 | — | — | 44 | 44 |
| Hi-milan 1855 *7 | — | — | 10 | — | — | — | — | — | 10 | 10 | — | — |
| Surlyn 8945 *8 | — | — | 46 | — | — | — | — | — | 46 | 46 | — | — |
| Surlyn 9945 *9 | — | — | 37 | — | — | — | — | — | 37 | 37 | — | — |
| Surlyn AD8542 *10 | — | — | — | — | — | — | — | — | — | — | — | — |
| Pebax 2533 *11 | — | — | 5 | — | — | — | — | — | 5 | 5 | — | — |
| Epofriend A1010 *12 | — | — | 2 | — | — | — | — | — | 2 | 2 | — | — |

TABLE 7

(parts by weight)

| Cover composition | Comparative Example No. 1 | 2 | 3 | 4 | 5 | 6 | 7 | 8 | 9 | 10 | 11 |
|---|---|---|---|---|---|---|---|---|---|---|---|
| Hi-milan 1555 *2 | 6 | 6 | 6 | 6 | 47 | 6 | — | — | 10 | 6 | — |
| Hi-milan 1557 *3 | 6 | 6 | 6 | 6 | — | 6 | — | — | — | 6 | — |
| Hi-milan 1605 *4 | 44 | 44 | 44 | 44 | — | 44 | 32 | 32 | 5 | 44 | — |
| Hi-milan 1702 *5 | — | — | — | — | 27 | — | — | — | — | — | — |
| Hi-milan 1706 *6 | 44 | 44 | 44 | 44 | — | 44 | 30 | 30 | — | 44 | — |
| Hi-milan 1855 *7 | — | — | — | — | — | — | 20 | 20 | 85 | — | 10 |
| Surlyn 8945 *8 | — | — | — | — | — | — | — | — | — | — | 46 |
| Surlyn 9945 *9 | — | — | — | — | — | — | — | — | — | — | 37 |
| Surlyn AD8542 *10 | — | — | — | — | 10 | — | — | — | — | — | — |
| Pebax 2533 *11 | — | — | — | — | 12 | — | 10 | 10 | — | — | 5 |
| Epofriend A1010 *12 | — | — | — | — | 10 | — | 8 | 8 | — | — | 2 |

*2 Hi-milan 1555 (trade name), ethylene-methacrylic acid copolymer ionomer resin obtained by neutralizing with sodium ion, manufactured by Mitsui Du Pont Polychemical Co., Ltd., Shore D hardness: 61, flexural modulus: 300 MPa

*3 Hi-milan 1557 (trade name), ethylene-methacrylic acid copolymer ionomer resin obtained by neutralizing with zinc ion, manufactured by Mitsui Du Pont Polychemical Co., Ltd., Shore D hardness: 63, flexural modulus: 215 MPa

*4 Hi-milan 1605 (trade name), ethylene-methacrylic acid copolymer ionomer resin obtained by neutralizing with sodium ion, manufactured by Mitsui Du Pont Polychemical Co., Ltd., Shore D hardness: 62, flexural modulus: 310 MPa

*5 Hi-milan 1702 (trade name), ethylene-methacrylic acid copolymer ionomer resin obtained by neutralizing with zinc ion, manufactured by Mitsui Du Pont Polychemical Co., Ltd., Shore D hardness: 62, flexural modulus: 150 MPa

*6 Hi-milan 1706 (trade name), ethylene-methacrylic acid copolymer ionomer resin obtained by neutralizing with zinc ion, manufactured by Mitsui Du Pont Polychemical Co., Ltd., Shore D hardness: 60, flexural modulus: 270 MPa

*7 Hi-milan 1855 (trade name), ethylene-methacrylic acid-isobutyl acrylate terpolymer ionomer resin obtained by neutralizing with zinc ion, manufactured by Mitsui Du Pont Polychemical Co., Ltd., Shore D hardness: 54, flexural modulus: 87 MPa

*8 Surlyn 8945 (trade name), ethylene-methacrylic acid copolymer ionomer resin obtained by neutralizing with sodium ion, manufactured by DuPont USA Co., Shore D hardness: 63, flexural modulus: 270 MPa

*9 Surlyn 9945 (trade name), ethylene-methacrylic acid copolymer ionomer resin obtained by neutralizing with zinc ion, manufactured by Du Pont Co., Shore D hardness: 61, flexural modulus: 270 MPa TABLE 7-continued (parts by weight)

| Cover composition | Comparative Example No. 1 | 2 | 3 | 4 | 5 | 6 | 7 | 8 | 9 | 10 | 11 |
|---|---|---|---|---|---|---|---|---|---|---|---|

*10 Suryln AD8542 (trade name), ethylene-methacrylic acid copolymer ionomer resin obtained by neutralizing with magnesium ion, manufactured by Du Pont Co., Shore D hardness: 44, flexural modulus: 35 MPa

*11 Pebax 2533 (trade name), polyether amide thermoplastic elastomer, manufactured by ELF Atochem Co.

*12 Epofriend AT1010 (trade name), styrene-butadiene-styrene (SBS) block copolymer with epoxy groups, manufactured by Daicel Chemical Industries, Ltd., JIS-A hardness = 67, styrene/butadiene (weight ratio) = 40/60, content of epoxy = about 1.5 to 1.7% by weight

Examples 1 to 12 and Comparative Examples 1 to 11

The cover composition was covered on the resulting core 4 having two-layered structure by injection molding to form a cover layer 3 having the thickness shown in Tables 8 and 9 (Examples) and Tables 10 and 11 (Comparative Examples). Then, paint was applied on the surface to produce golf ball having a diameter of 42.7 mm. With respect to the resulting golf balls, the initial velocity, launch angle, flight distance and shot feel were measured or evaluated. The results are shown in Tables 8 and 9 (Examples) and Tables 10 and 11 (Comparative Examples). The test methods are described later.

(Test Method)

(1) Shore D Hardness of Cover

After the golf ball is obtained by covering the core with the cover, a Shore D hardness of the cover is determined by measuring a hardness at the surface of the golf ball at 23° C. using a Shore D hardness meter according to ASTM D-2240.

(2) Flight Performance

A No.5 iron club (I#5) was mounted to a swing robot manufactured by True Temper Co. and the resulting golf ball was hit at a head speed of 30 m/second, the initial velocity, launch angle, spin amount and flight distance were measured. The spin amount was measured by continuously taking a photograph of a mark provided on the hit golf ball using a high-speed camera. AS the flight distance, carry that is a distance to the dropping point of the hit golf ball was measured.

(3) Shot Feel

The shot feel of the resulting golf ball was evaluated by 10 professional golfers and top amateur golfers according to practical hitting test by a driver. The evaluation criteria are as follows.

(Evaluation Criteria)

oo: All 10 golfers felt that the golf ball has good shot feel; Very soft and good.

o: From 8 to 9 out of 10 golfers felt that the golf ball has good shot feel; Soft and good.

Δ: From 4 to 7 out of 10 golfers felt that the golf ball has good shot feel; Fairly good.

ΔH: From 4 to 7 out of 10 golfers felt that the golf ball has good shot feel; Slightly hard.

ΔW: From 4 to 7 out of 10 golfers felt that the golf ball has good shot feel; Slightly heavy.

×H: Not more than 3 out of 10 golfers felt that the golf ball has good shot feel; Hard and poor.

×W: Not more than 3 out of 10 golfers felt that the golf ball has poor shot feel; Heavy and poor.

TABLE 8

| Test item | Example No. 1 | 2 | 3 | 4 | 5 | 6 |
|---|---|---|---|---|---|---|
| Diameter of inner core (mm) | 36.2 | 36.2 | 36.2 | 36.2 | 36.2 | 36.2 |
| Thickness of outer core (mm) | 1.4 | 1.4 | 1.4 | 1.4 | 1.4 | 1.4 |
| Thickness of cover (mm) | 1.9 | 1.9 | 1.9 | 1.9 | 1.9 | 1.9 |
| Hardness of inner core (JIS-C hardness) | | | | | | |
| Center point(A) | 66 | 64 | 64 | 64 | 62 | 59 |
| 15 mm from center point (B) | 77 | 74 | 74 | 70 | 72 | 67 |
| Hardness difference (B–A) | 11 | 10 | 10 | 6 | 10 | 8 |
| Hardness of outer core (JIS-C hardness) | | | | | | |
| Surface hardness(C) | 80 | 84 | 84 | 84 | 84 | 87 |
| Hardness difference (C–A) | 14 | 20 | 20 | 20 | 22 | 28 |
| Outermost cover layer | | | | | | |
| Shore D hardness | 69 | 69 | 66 | 69 | 69 | 69 |
| JIS-C hardness | 99 | 99 | 96 | 99 | 99 | 99 |
| Properties of golf ball | | | | | | |
| Initial velocity (m/sec) | 44.0 | 43.9 | 43.7 | 44.0 | 43.8 | 43.8 |
| Launch angle (degree) | 17.2 | 17.3 | 17.4 | 17.2 | 17.4 | 17.5 |
| Spin amount (rpm) | 4150 | 4100 | 4020 | 4110 | 3990 | 3780 |
| Flight distance (yard) | 133.0 | 132.3 | 133.4 | 133.2 | 132.3 | 133.1 |
| Shot feel | ○ | ○○ | ○○ | ○○ | ○○ | ○ |

TABLE 9

| Test item | Example No. 7 | 8 | 9 | 10 | 11 | 12 |
|---|---|---|---|---|---|---|
| Diameter of inner core (mm) | 35.4 | 35.6 | 37.4 | 38.0 | 36.2 | 38.0 |
| Thickness of outer core (mm) | 1.4 | 1.7 | 1.4 | 1.4 | 1.4 | 0.5 |
| Thickness of cover (mm) | 2.3 | 1.9 | 1.9 | 1.9 | 1.9 | 1.9 |
| Hardness of inner core (JIS-C hardness) | | | | | | |
| Center point(A) | 64 | 64 | 64 | 64 | 64 | 64 |
| 15 mm from center point (B) | 74 | 74 | 74 | 74 | 74 | 74 |
| Hardness difference (B–A) | 10 | 10 | 10 | 10 | 10 | 10 |
| Hardness of outer core (JIS-C hardness) | | | | | | |
| Surface hardness (C) | 84 | 84 | 84 | 84 | 84 | 84 |
| Hardness difference (C–A) | 20 | 20 | 20 | 20 | 20 | 20 |

TABLE 9-continued

| Test item | Example No. 7 | 8 | 9 | 10 | 11 | 12 |
|---|---|---|---|---|---|---|
| Outermost cover layer | | | | | | |
| Shore D hardness | 69 | 69 | 66 | 66 | 69 | 69 |
| JIS-C hardness | 99 | 99 | 96 | 96 | 99 | 99 |
| Properties of golf ball | | | | | | |
| Initial velocity (m/sec) | 44.1 | 44.0 | 43.8 | 43.7 | 43.7 | 43.9 |
| Launch angle (degree) | 17.4 | 17.2 | 17.5 | 17.4 | 17.3 | 17.4 |
| Spin amount (rpm) | 4000 | 4110 | 4040 | 4050 | 4050 | 4100 |
| Flight distance (yard) | 133.5 | 132.9 | 133.9 | 133.0 | 132.1 | 133.0 |
| Shot feel | ○ | ○ | ○○ | ○○ | ○ | ○○ |

TABLE 10

| Test item | Comparative Example No. 1 | 2 | 3 | 4 | 5 |
|---|---|---|---|---|---|
| Diameter of inner core (mm) | 36.2 | 36.2 | 36.2 | 36.2 | 36.2 |
| Thickness of outer core (mm) | 1.4 | 1.4 | 1.4 | 1.4 | 1.4 |
| Thickness of cover (mm) | 1.9 | 1.9 | 1.9 | 1.9 | 1.9 |
| Hardness of inner core (JIS-C hardness) | | | | | |
| Center point(A) | 72 | 70 | 72 | 64 | 64 |
| 15 mm from center point (B) | 78 | 72 | 78 | 74 | 74 |
| Hardness difference (B–A) | 6 | 2 | 6 | 10 | 10 |
| Hardness of outer core (JIS-C hardness) | | | | | |
| Surface hardness(C) | 84 | 84 | 80 | 74 | 84 |
| Hardness difference (C–A) | 12 | 14 | 8 | 10 | 20 |
| Outermost cover layer | | | | | |
| Shore D hardness | 69 | 69 | 69 | 69 | 58 |
| JIS-C hardness | 99 | 99 | 99 | 99 | 88 |
| Properties of golf ball | | | | | |
| Initial velocity (m/sec) | 44.1 | 44.0 | 44.0 | 43.6 | 43.2 |
| Launch angle (degree) | 17.1 | 17.0 | 17.1 | 17.2 | 16.6 |
| Spin amount (rpm) | 4250 | 4270 | 4210 | 4100 | 4800 |
| Flight distance (yard) | 131.5 | 130.2 | 130.9 | 129.5 | 125.3 |
| Shot feel | xH | ΔH | ΔW | xW | ΔW |

TABLE 11

| Test item | Comparative Example No. 6 | 7 | 8 | 9 | 10 | 11 |
|---|---|---|---|---|---|---|
| Diameter of inner core (mm) | 31.5 | 36.2 | 36.2 | 36.2 | 36.2 | 36.2 |
| Thickness of outer core (mm) | 3.75 | 1.4 | 1.4 | 1.4 | 1.4 | 1.4 |

TABLE 11-continued

| Test item | Comparative Example No. 6 | 7 | 8 | 9 | 10 | 11 |
|---|---|---|---|---|---|---|
| Thickness of cover (mm) | 1.9 | 1.9 | 1.9 | 1.9 | 1.9 | 1.9 |
| Hardness of inner core (JIS-C hardness) | | | | | | |
| Center point(A) | 64 | 64 | 64 | 64 | 64 | 64 |
| 15 mm from center point (B) | 74 | 74 | 74 | 74 | 74 | 74 |
| Hardness difference (B–A) | 10 | 10 | 10 | 10 | 10 | 10 |
| Hardness of outer core (JIS-C hardness) | | | | | | |
| Surface hardness (C) | 84 | 84 | 84 | 84 | 84 | 84 |
| Hardness difference (C–A) | 20 | 20 | 20 | 20 | 20 | 20 |
| Outermost cover layer | | | | | | |
| Shore D hardness | 69 | 63 | 63 | 60 | 69 | 66 |
| JIS-C hardness | 99 | 93 | 93 | 90 | 99 | 96 |
| Properties of golf ball | | | | | | |
| Initial velocity (m/sec) | 44.2 | 43.4 | 43.0 | 42.7 | 43.5 | 43.3 |
| Launch angle (degree) | 16.8 | 16.7 | 16.5 | 16.2 | 17.1 | 17.0 |
| Spin amount (rpm) | 4320 | 4500 | 4550 | 4750 | 4250 | 4300 |
| Flight distance (yard) | 129.9 | 127.8 | 124.0 | 122.0 | 128.8 | 128.2 |
| Shot feel | xH | Δ | xH | xW | xH | xH |

As is apparent from the results of Tables 8 to 11, the golf balls of the present invention of Examples 1 to 12, which adjust a diameter, center hardness and hardness distribution of the inner core, a thickness and a surface hardness of the outer core, a hardness distribution of the core and a thickness and hardness of the cover to a specified range, have larger launch angle, longer flight distance and much better shot feel when hitting by a No.5 iron club compared with the golf balls of Comparative Examples 1 to 11.

On the other hand, in the golf ball of Comparative Example 1, the shot feel is hard and poor and the launch angle is small, which reduces the flight distance, because the center hardness of the inner core is high.

In the golf ball of Comparative Example 2, the launch angle is small, which reduces the flight distance, because the difference between a center hardness of the inner core and a hardness at a distance of 15 mm from the center point of the inner core is small.

In the golf ball of Comparative Example 3, the shot feel is poor and the launch angle is small, which reduces the flight distance, because the center hardness of the inner core is high. In addition, the launch angle is small, which reduces the flight distance, because the difference between a surface hardness of the outer core and a center hardness of the inner core is small.

In the golf ball of Comparative Example 4, the launch angle is small, which reduces the flight distance, because the surface hardness of the outer core is low. has larger difference between a center hardness of the inner core and a surface hardness of the outer core, and thus has poor durability.

In the golf ball of Comparative Example 5, the launch angle is small and the spin amount is large, which reduces the flight distance, because the hardness of the outmost layer of the cover is low.

In the golf ball of Comparative Example 6, the launch angle is small, which reduces the flight distance, and the shot feel is hard and poor, because the thickness of the outer core is large.

In the golf ball of Comparative Example 7, the launch angle is small and the spin amount is large, which reduces the flight distance, because the hardness of the outmost layer of the cover is low.

In the golf ball of Comparative Example 8, the shot feel is hard and poor, because the outer core, which is not formed from the rubber composition, is formed from thermoplastic resin. In addition, the launch angle is small and the spin amount is large, which reduces the flight distance, because the hardness of the outmost layer of the cover is low. The golf ball of Comparative Example 8 has harder and poorer shot feel and shorter flight distance compared with that of Comparative Example 7, because the golf ball of Comparative Example 8 is produced as described in Comparative Example 7 excepted that the outer core, which is not formed from the rubber composition, is formed from thermoplastic resin.

In the golf ball of Comparative Example 9, the core is formed from thermoplastic resin as described in Comparative Example 8, and the cover has different formulation from that of Comparative Example 8. Therefore the shot feel is hard and poor, and the launch angle is small and the spin amount is large, which reduces the flight distance, because the hardness of the outmost layer of the cover is lower than that of Comparative Example 8.

In the golf balls of Comparative Examples 10 and 11, the outer core, which is not formed from the rubber composition, is formed from thermoplastic resin. Therefore the shot feel is hard and poor, and the rebound characteristics are degraded and the initial velocity is small, which reduces the flight distance.

TABLE A

| | Elements | Present Invention | Kim | Hiraoka |
|---|---|---|---|---|
| Ball | Three piece solid golf ball composed of an inner core, an outer core and a cover | ○ | ○ | ○ |
| Inner core | Diameter (mm) | 32.5~38.5 | ○23~35 | ○ 25~37 |
| | Center hardness (JIS-C) | 59~67 | ○30~48 Shore D (JIS-C50~73) | ○ 60~85 |

TABLE A-continued

| | Elements | Present Invention | Kim | Hiraoka |
|---|---|---|---|---|
| | JIS-C hardness at a distance of 15 mm from the center point | 65 to 85 and higher than center point by 5 to 20 | Δ ## explained later (Example 1 and 2 of Table 1 and Table 1 continues) | X: Hardness difference between center and surface being not more than 4 |
| | Formed from rubber composition | ○ | ○ | ○ |
| Outer core | Thickness (mm) | 0.5~1.8 | ○ 0.5~9.0 (calculated from FIG.1) | ○ 1~7 |
| | Surface hardness (JIS-C) | 79~88 | Δ30~56 Shore D (50~84 JIS-C) | ○ 75~90 |
| | Hardness difference between surface hardness and center point of the inner core | Surface is harder than center by 15 to 30 | Δ ## explained later (Example 1 and 2 of Table 1 and Table 1 continues) | X: Hardness difference between center and surface being not more than 4 |
| | Formed from rubber composition | ○ | ○ | ○ |
| Cover | Combination of ionomer resin and at least one of thermoplastic elastomer or diene block copolymer | ○ | X: Ionomer or polyurethane (column 6, lines 35–38) | ○ Combination of ionomer resin and thermoplastic resin (polyamide etc.) |
| | Amount of thermoplastic elastomer or diene block copolymer being 1 to 35 parts by weight based on 180 parts by weight of base resin. | ○ | X: No description | X: No description regarding amounts of thermoplastic resin |
| | Cover thickness (mm) | 1.5~2.5 | ○ 0.9~2.6 (column 6, line 32) | ○ 1~4 |
| | Cover hardness (Shore D) | 66~69 | X: No description | ○ 59~70 |

TABLE B

| | Table 1 | | Table 1 continued | |
|---|---|---|---|---|
| | Ex. 1 | Ex. 2 | Ex. 1 | Ex. 2 |
| Center | 42 Shore D (66 JIS-C) | 42 Shore D (66 JIS-C) | 38 Shore D (60 JIS-C) | 39 Shore D (62 JIS-C) |
| Site 15 mm apart from center | 56 Shore D (84 JIS-C) | 55 Shore D (83 JIS-C) | 45 Shore D (70 JIS-C) | 39 Shore D (62 JIS-C) |
| Site 18 mm apart from center | 55 Shore D (83 JIS-C) | 54 Shore D (82 JIS-C) | 44 Shore D (68 JIS-C) | 38 Shore D (61 JIS-C) |
| (Site 15 mm)-(Center) | 84 − 66 = 18 JIS-C | 83 − 66 = 17 JIS-C | 70 − 60 = 10 JIS-C | 62 − 62 = 0 JIS-C |
| (Site 18 mm)-(Center) | 83 − 66 = 17 JIS-C | 82 − 66 = 16 JIS-C | 68 − 60 = 6 JIS-C | 61 − 62 = −1 JIS-C |

What is claimed is:

1. A three piece solid golf ball comprising a core consisting of an inner core and an outer core formed on the inner core, and one layer of cover covering the core, wherein the inner core has a diameter of 32.5 to 38.5 mm and a center hardness in JIS-C hardness of 59 to 67, and is formed from a press molded rubber composition comprising polybutadiene, a co-crosslinking agent, an organic peroxide and a filler, and the JIS-C hardness at a distance of 15 mm from the center point of the inner core is 65 to 85 and is higher than the center hardness by 5 to 20, the outer core has a thickness of 0.5 to 1.8 mm and a surface hardness in JIS-C hardness of 79 to 88, and is formed from a press molded rubber composition comprising polybutadiene, a co-crosslinking agent, an organic peroxide and a filler, and the surface hardness of the outer core is higher than the center hardness of the inner core by 20 to 30, and the cover is formed from a combination of an ionomer resin and at least one of thermoplastic elastomer or diene block copolymer, an amount of the thermoplastic elastomer or diene block copolymer being 1 to 35 parts by weight based on 100 parts by weight of the base resin for the cover, and the cover layer has a thickness of 1.5 to 2.5 mm and a surface hardness in Shore D hardness of 66 to 69.

2. A three piece solid golf ball comprising a core consisting of an inner core and an outer core formed on the inner core, and one layer of cover covering the core, wherein the inner core has a diameter of 32.5 to 38.5 mm and a center hardness in JIS-C hardness of 59 to 67, and is formed from a press molded rubber composition comprising polybutadiene, a co-crosslinking agent, an organic peroxide and a filler, and the JIS-C hardness at a distance of 15 mm from the center point of the inner core is 65 to 85 and is higher than the center hardness by 5 to 15, the outer core has a thickness of 0.5 to 1.8 mm and a surface hardness in JIS-C hardness of 79 to 88, and is formed from a press molded rubber composition comprising polybutadiene, a co-crosslinking agent, an organic peroxide and a filler, and the surface hardness of the outer core is higher than the center hardness of the inner core by 15 to 30, and the cover is formed from a combination of an ionomer resin and at least one of thermoplastic elastomer or diene block copolymer, an amount of the thermoplastic elastomer or diene block copolymer being 1 to 35 parts by weight based on 100 parts by weight of the base resin for the cover, and the cover layer has a thickness of 1.5 to 2.5 mm and a surface hardness in Shore D hardness of 66 to 69.

3. A three piece solid golf ball comprising a core consisting of an inner core and an outer core formed on the inner core, and one layer of cover covering the core, wherein the inner core has a diameter of 32.5 to 38.5 mm and a center hardness in JIS-C hardness of 59 to 67, and is formed from a press molded rubber composition comprising polybutadiene, a co-crosslinking agent, an organic peroxide and a filler, and the JIS-C hardness at a distance of 15 mm from the center point of the inner core is 70 to 80 and is higher than the center hardness by 5 to 20, the outer core has a thickness of 0.5 to 1.8 mm and a surface hardness in JIS-C hardness of 82 to 86, and is formed from a press molded rubber composition comprising polybutadiene, a co-crosslinking agent, an organic peroxide and a filler, and the surface hardness of the outer core is higher than the center hardness of the inner core by 15 to 30, and the cover is formed from a combination of an ionomer resin and at least one of thermoplastic elastomer or diene block copolymer, an amount of the thermoplastic elastomer or diene block copolymer being 1 to 35 parts by weight based on 100 parts by weight of the base resin for the cover, and the cover layer has a thickness of 1.5 to 2.5 mm and a surface hardness in Shore D hardness of 66 to 69.

4. A three piece solid golf ball comprising a core consisting of an inner core and an outer core formed on the inner core, and one layer of cover covering the core, wherein the inner core has a diameter of 32.5 to 38.5 mm and a center hardness in JIS-C hardness of 59 to 67, and is formed from a press molded rubber composition comprising polybutadiene, a co-crosslinking agent, an organic peroxide and a filler, and the JIS-C hardness at a distance of 15 mm from the center point of the inner core is 70 to 80 and is higher than the center hardness by 5 to 15, the outer core has a thickness of 0.5 to 1.8 mm and a surface hardness in JIS-C hardness of 82 to 86, and is formed from a press molded rubber composition comprising polybutadiene, a co-crosslinking agent, an organic peroxide and a filler, and the surface hardness of the outer core is higher than the center hardness of the inner core by 20 to 30, and the cover is formed from a combination of an ionomer resin and at least one of thermoplastic elastomer or diene block copolymer, an amount of the thermoplastic elastomer or diene block copolymer being 1 to 35 parts by weight based on 100 parts by weight of the base resin for the cover, and the cover layer has a thickness of 1.5 to 2.5 mm and a surface hardness in Shore D hardness of 66 to 69.

* * * * *